US007320351B2

(12) United States Patent
Chern

(10) Patent No.: US 7,320,351 B2
(45) Date of Patent: Jan. 22, 2008

(54) TAPE CUTTER

(75) Inventor: Shyue Jinn Chern, Linkou Township, Taipei County (TW)

(73) Assignee: Huah Jinn Tape Searching Co., Ltd., Taipei County (TW)

( * ) Notice: Subject to any disclaimer, the term of this patent is extended or adjusted under 35 U.S.C. 154(b) by 434 days.

(21) Appl. No.: 11/064,947

(22) Filed: Feb. 25, 2005

(65) Prior Publication Data

US 2006/0191642 A1 Aug. 31, 2006

(51) Int. Cl.
*B32B 37/22* (2006.01)

(52) U.S. Cl. ..... 156/523; 156/574; 156/577

(58) Field of Classification Search ..... 156/523, 156/527, 574, 577
See application file for complete search history.

(56) References Cited

U.S. PATENT DOCUMENTS 3,523,053 A * 8/1970 Dodd et al. ..... 156/523
4,238,271 A * 12/1980 Urushizaki ..... 156/523
4,345,966 A * 8/1982 Iiyama et al. ..... 156/523
4,804,437 A * 2/1989 Tirtoprodjo et al. ..... 156/577
5,326,421 A * 7/1994 Taylor ..... 156/526
6,053,233 A * 4/2000 Lin ..... 156/523
6,510,884 B1 * 1/2003 Chan ..... 156/527
6,896,025 B2 * 5/2005 Urushizaki ..... 156/523

* cited by examiner

*Primary Examiner*—Mark A Osele
(74) *Attorney, Agent, or Firm*—Troxell Law Office, PLLC

(57) ABSTRACT

Provided is a tape cutter comprising a housing comprising a rear spring, a forward opening, and a forward tape press roller; a tape dispensing unit urged by the spring and comprising a tape mount with an adhesive tape roll rotatably put thereon, and a push member projected from the opening; and a cutter unit pivotably mounted in the housing and comprising a front cutting blade and a top ridge. Placing the cutter on a surface to be sealed with the tape slightly projected from the opening and adhered on the surface and sliding the cutter will press the tape against the surface by the tape press roller for adhering thereto. After dispensing a desired length of the tape, pushing the push member will cause it to press down and pass over the ridge and press the blade to cut the tape off its roll with the spring being compressed.

4 Claims, 5 Drawing Sheets

TAPE CUTTER

BACKGROUND OF THE INVENTION

1. Field of Invention

The present invention relates to tape cutters and more particularly to such a tape cutter with improved characteristics.

2. Related Art

Tape cutters are well known devices. For example, U.S. Pat. No. 4,097,328 discloses a tape cutter as shown in FIG. 1. In operation, the cutter is placed on a surface to be sealed and a swing member 1 rotatably mounted on a cutter body 3 to be swingable about a tubular portion 6 mounted on a shaft 5 is pivoted down to cause a tape press roller 9 and a leading end of an adhesive tape 2 put on a tubular tape mount 1*a* to protrude out of an opening 10 in a bottom of the body 3. When the cutter is slid on the surface with the tape 2 pressed against the surface by the tape press roller 9, the tape 2 is adhered to the surface. When a desired length of the tape 2 has been put thereon, the swing member 1 is then released to return to its normal position under the resilience of a flat spring 7. The tape press roller 9 will withdraw into the body 3, and a blade mounting disc 12 and thus a cutting blade 15 mounted on a blade carrying portion 12' rotate counterclockwise to cut the tape 2 off its roll 12'. The cutter further comprises a tape guide bar 11 for guiding a tape and a removable side plate 17 for allowing a new tape roll to set on the tape mount 1*a*.

But this is unsatisfactory for the purpose for which the invention is concerned for being complicated in construction, resulting in an increase in the manufacturing cost. Thus, the need for improvement still exists.

SUMMARY OF THE INVENTION

It is therefore an object of the present invention to provide a tape cutter having advantages of being safe in operations, having simplified components, being operable by a single hand, and being applicable to a variety of adhesive tapes.

The above and other objects of the present invention are realized by providing a device for cutting an adhesive tape comprising a housing comprising a resilient assembly anchored onto a rear inner wall, a forward opening, a forward tape press roller, and a lateral shaft; a tape dispensing unit urged by the resilient assembly and comprising a tubular tape mount with an adhesive tape in a form of roll rotatably put thereon, and a push member projected from the opening; and a cutter unit comprising a rear tubular portion rotatably mounted on the shaft, a front cutting blade, and a top ridge disposed proximate the push member, whereby placing the device on a surface to be sealed with an open end of the tape slightly projected from the opening and adhered on the surface and sliding the device on the surface in a direction will press the tape against the surface by the tape press roller for adhering the tape to the surface; and after a desired length of the tape has been put thereon, pushing the push member in the same direction will cause it to press down and pass over the ridge and press the blade to cut the tape off its roll with the resilient assembly being compressed.

In one aspect of the present invention, the tape dispensing unit further comprises a tape guide below the push member for pressing onto the tape, and a platform proximate the tape guide, and wherein the platform and the tape guide are adapted to facilitate the pulling of the tape out of the device.

In another aspect of the present invention, the resilient assembly comprises a bar projected forwardly from the rear inner wall of the housing into a rear recess of the tape dispensing unit, and a coil spring put on the bar and biased between the rear inner wall of the housing and the recess.

The above and other objects, features and advantages of the present invention will become apparent from the following detailed description taken with the accompanying drawings.

DETAILED DESCRIPTION OF THE INVENTION

Figure 1:
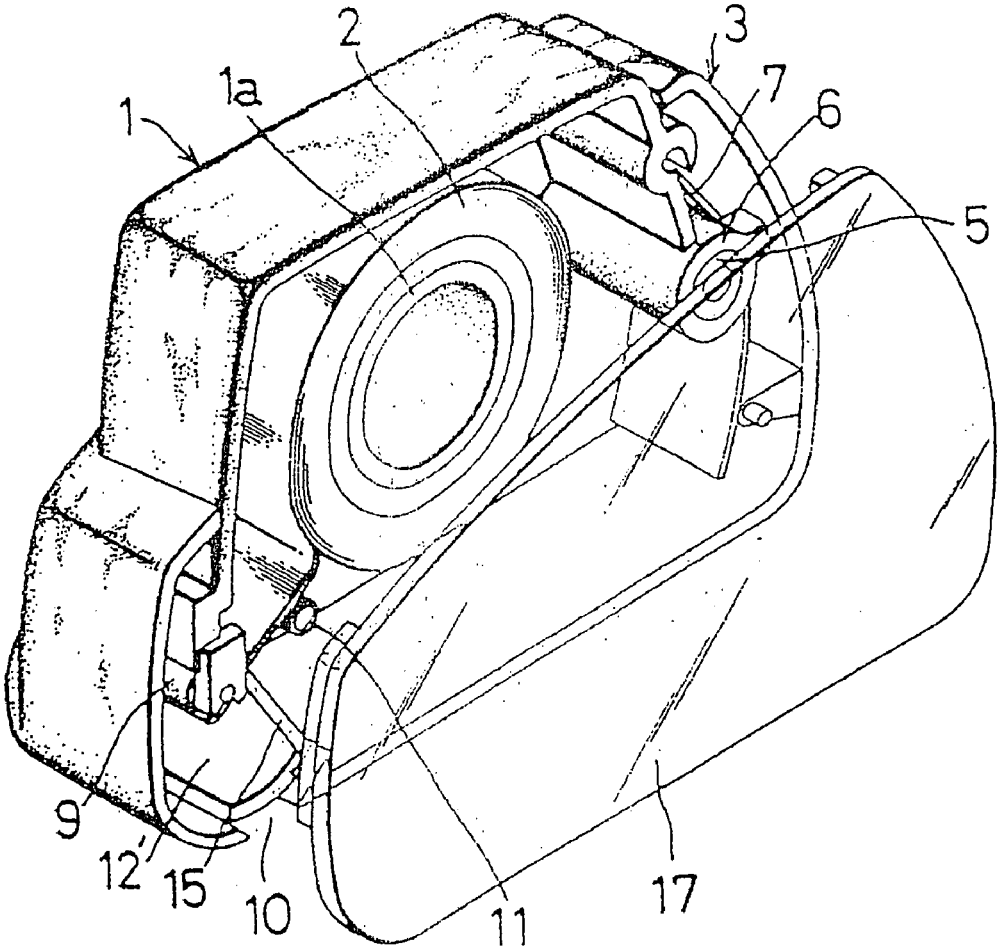
Fig. 1 Prior Art
FIG. 1 is a perspective view of a tape cutter disclosed in U.S. Pat. No. 4,097,328 with the side plate removed.
Figure 2:
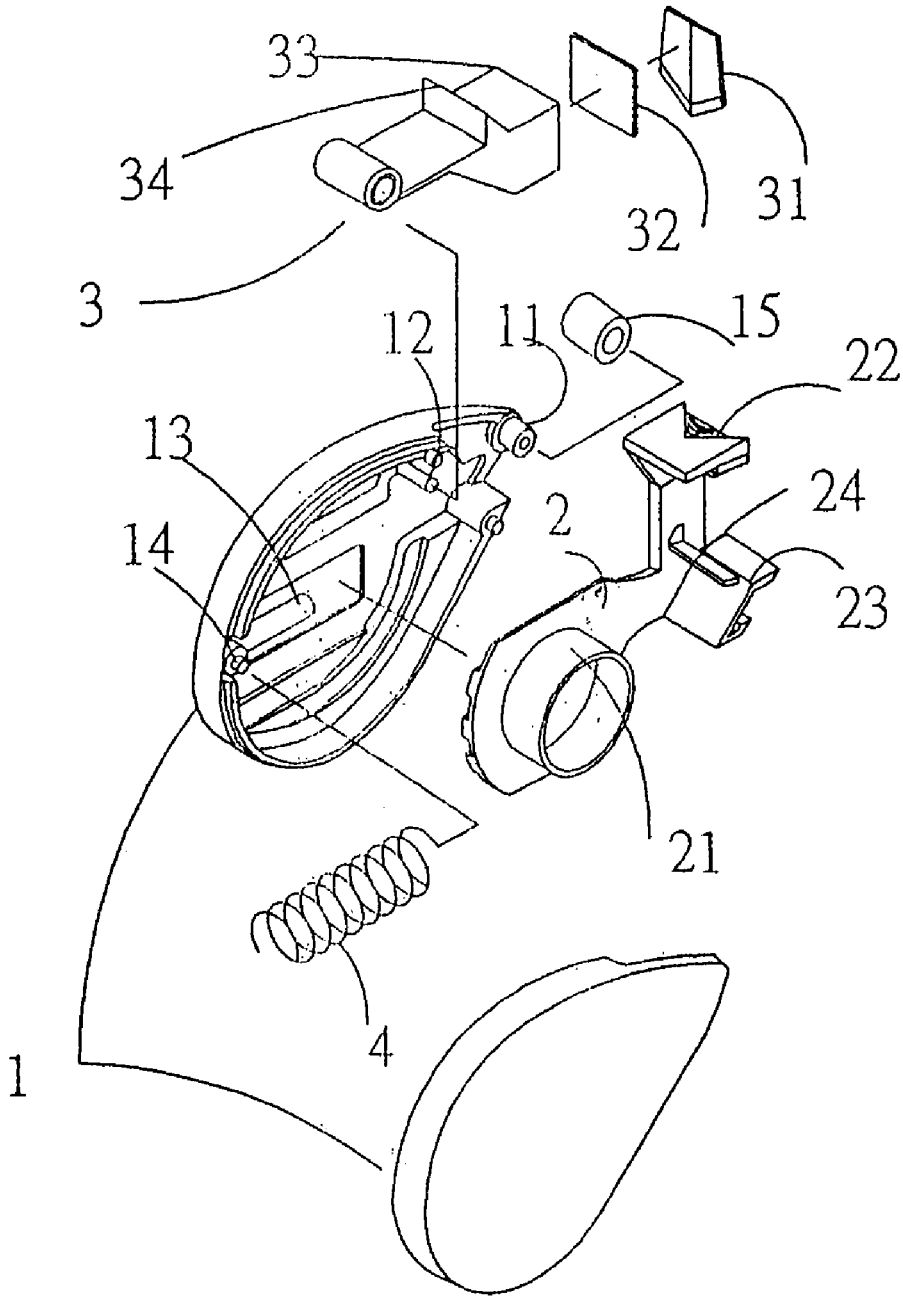
FIG. 2 is an exploded view of a preferred embodiment of tape cutter according to the invention.
Figure 3:
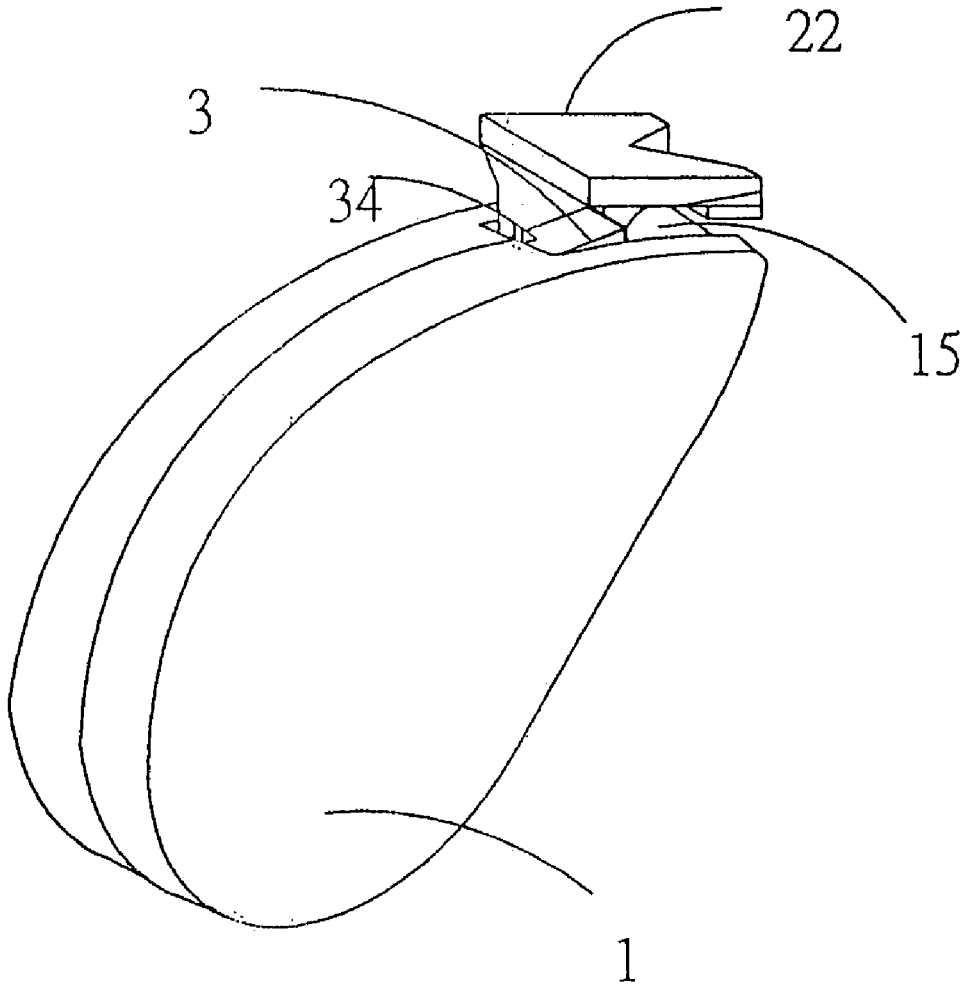
FIG. 3 is a perspective view of the assembled cutter of FIG. 2.

Referring to FIGS. 2 and 3, there is shown a tape cutter constructed in accordance with a preferred embodiment of the invention. The cutter comprises a housing 1 consisting of two mated side plates. Within the housing 1 there are provided at least one tab 14 at one side plate, each tab 14 adapted to snugly insert into a hole (not shown) at the other side plate for fastening both side plates together, a bar 13 projected forwardly from a rear end, a first shaft 11 at a forward opening with a tape press roller 15 rotatably mounted thereon, and a second shaft 12 projected laterally from one side plate.

The cutter further comprises a tape dispensing unit 2 including a tubular tape mount 21 with an adhesive tape roll to be rotatably put thereon, a push member 22 projected from the opening, a tape guide 24 below the push member 22 for pressing onto a tape (not shown), and a platform 23 proximate the tape guide 24. The platform 23 and the tape guide 24 are adapted to facilitate the pulling of tape out of the cutter.

The cutter further comprises a coil spring 4 put on the bar 13 and biased between an inner wall of the cutter and a rear recess of the tape dispensing unit 2 such that the tape dispensing unit 2 is able to move closer to the inner wall of the cutter by compressing the spring 4 in a tape cutting operation after dispensing a tape as detailed later.

The cutter further comprises a cutter unit 3 having a rear tubular portion rotatably mounted on the second shaft 12 and including a front cutting blade 31, a block member 33, a mounting plate 32 for fixedly fastening the blade 31 onto a front end of the block member 33, and a top ridge 34 disposed proximate the push member 22.

Figure 4:
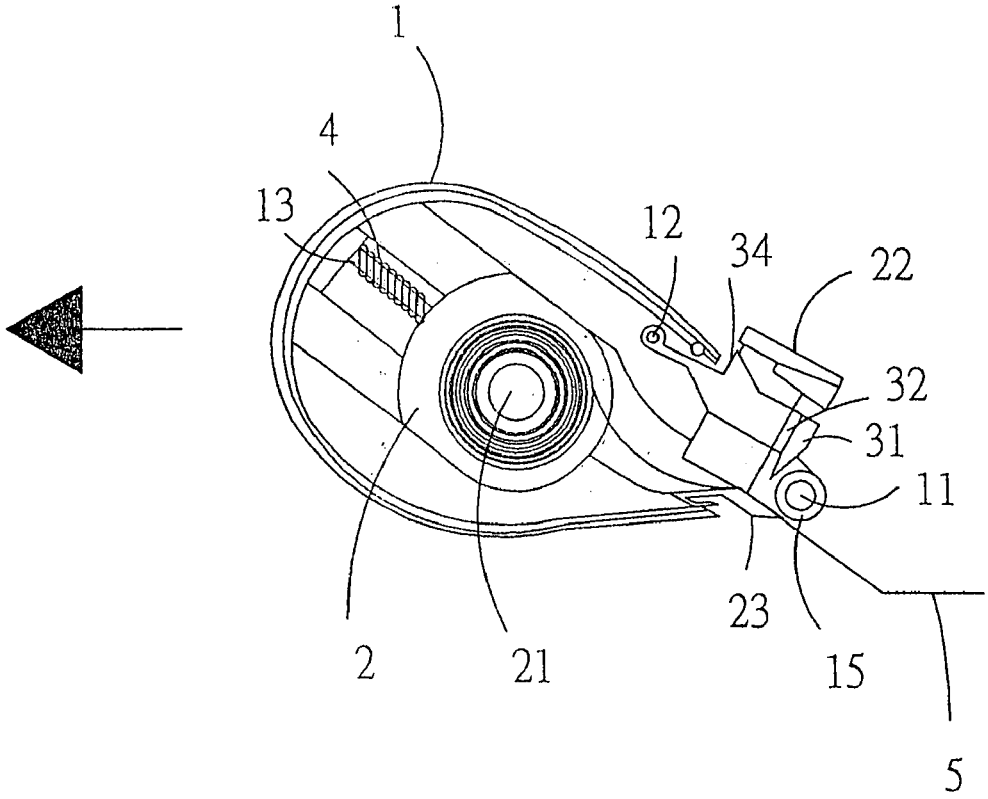
FIGS. 4 and 5 are side views of FIG. 3 with the side plate removed for showing tape dispensing and tape cutting operations of the cutter according to the invention respectively.

Referring to FIG. 4, in operation, the cutter is placed on a surface to be sealed with an open end of an adhesive tape roll 5 slightly projected from the opening and adhered on the surface. Next, slide the cutter on the surface in a direction as indicated by arrow with the tape 5 pressed against the surface by the tape press roller 15 for adhering the tape 5 to the surface.

Figure 5:
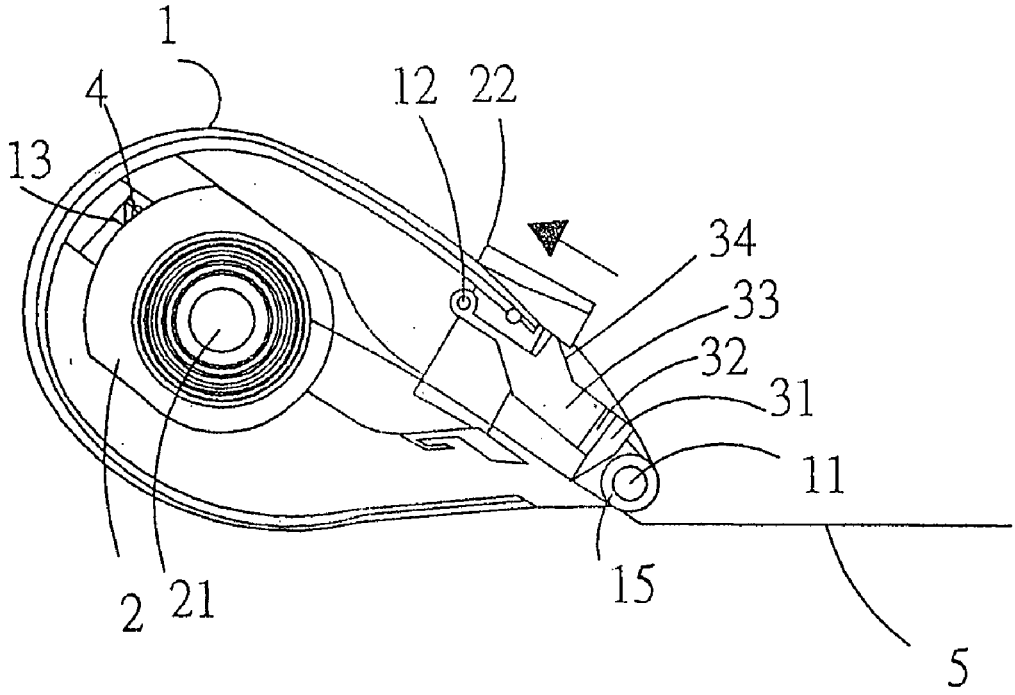

Referring to FIG. 5, when a desired length of the tape 5 has been put thereon, a user may push the push member 22 rearward as indicated by arrow to press down and pass over the ridge 34 until the ridge 34 is stopped by an edge of the opening. Also, the blade 31 is pressed to cut the tape 5 off its roll with the spring 4 being compressed. It is understood that releasing the push member 22 will cause both the tape dispensing unit 2 and the cutter unit 3 to return to their normal positions due to the expansion of the spring 4.

It is also understood from the aforesaid description that the tape cutter of the invention has the following advantages. First, the blade 31 is always disposed within the housing 1 in either operation. Thus, there is no need to worry the hand of a user may be hurt by the blade 31. Also, its components are much simplified. Moreover, it can be operated by a single hand. Finally, a variety of adhesive tapes are applicable.

While the invention herein disclosed has been described by means of specific embodiments, numerous modifications and variations could be made thereto by those skilled in the art without departing from the scope and spirit of the invention set forth in the claims.

What is claimed is:

1. A device for cutting an adhesive tape comprising:

a housing comprising a resilient assembly anchored onto a rear inner wall, a forward opening, a forward tape press roller, and a lateral shaft;

a tape dispensing unit urged by the resilient assembly and comprising a tubular tape mount with an adhesive tape in a form of roll rotatably put thereon, and a push member projected from the opening; and a cutter unit comprising a rear tubular portion rotatably mounted on the shaft, a front cutting blade, and a top ridge disposed proximate the push member, whereby placing the device on a surface to be sealed with an open end of the tape slightly projected from the opening and adhered on the surface and sliding the device on the surface in a direction will press the tape against the surface by the tape press roller for adhering the tape to the surface; and after a desired length of the tape has been put thereon, pushing the push member in the same direction will cause it to press down and pass over the ridge and press the blade to cut the tape off its roll with the resilient assembly being compressed.

2. The device of claim 1, wherein the tape dispensing unit further comprises a tape guide below the push member for pressing onto the tape, and a platform proximate the tape guide, and wherein the platform and the tape guide are adapted to facilitate the pulling of the tape out of the device.

3. The device of claim 1, wherein the resilient assembly comprises a bar projected forwardly from the rear inner wall of the housing into a rear recess of the tape dispensing unit, and a coil spring put on the bar and biased between the rear inner wall of the housing and the recess.

4. The device of claim 1, wherein the pushing of the push member is stopped by an edge of the opening.

* * * * *